US010982502B2

(12) United States Patent
Bjørkhaug

(10) Patent No.: US 10,982,502 B2
(45) Date of Patent: Apr. 20, 2021

(54) WELLHEAD ASSEMBLY

(71) Applicant: EQUINOR ENERGY AS, Stavanger (NO)

(72) Inventor: Magne Bjørkhaug, Bøvågen (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/718,451

(22) Filed: Dec. 18, 2019

(65) Prior Publication Data

US 2020/0123871 A1 Apr. 23, 2020

Related U.S. Application Data

(62) Division of application No. 15/502,943, filed as application No. PCT/NO2015/050135 on Aug. 17, 2015, now Pat. No. 10,697,265.

(30) Foreign Application Priority Data

Aug. 19, 2014 (GB) ..... 1414733

(51) Int. Cl.
*E21B 33/068* (2006.01)
*E21B 33/03* (2006.01)
*E21B 34/02* (2006.01)

(52) U.S. Cl.
CPC ..... *E21B 33/068* (2013.01); *E21B 33/03* (2013.01); *E21B 34/02* (2013.01)

(58) Field of Classification Search
CPC ..... E21B 33/03; E21B 33/035; E21B 33/068; E21B 43/02
See application file for complete search history.

(56) References Cited

U.S. PATENT DOCUMENTS 4,211,281 A 7/1980 Lawson
5,992,527 A 11/1999 Garnham et al.
(Continued)

FOREIGN PATENT DOCUMENTS

CN 87104321 A 3/1988
CN 102808591 A 12/2012
(Continued)

OTHER PUBLICATIONS

CN Office Action, CN 201580044134.6, dated Aug. 17, 2018 (7 pp.).
(Continued)

*Primary Examiner* — David Carroll
(74) *Attorney, Agent, or Firm* — Eversheds Sutherland (US) LLP

(57) ABSTRACT

There is provided a wellhead assembly that includes a production well, a first valve, process equipment, a transport pipe for transporting fluid away from the wellhead assembly, and piping fluidly connecting the production well to the first valve, process equipment, and the transport pipe. The first valve is located between the production well and the process equipment, and there is a fall in the piping between the first valve and the transport pipe such that when the first valve is closed liquid will drain from the first valve into the transport pipe under the action of gravity. There is also provided a method of draining the wellhead assembly, an arrangement for depressurising the wellhead assembly using a service line and a method of depressurising the wellhead assembly.

7 Claims, 1 Drawing Sheet

(56) References Cited

U.S. PATENT DOCUMENTS

| | | | | |
|---|---|---|---|---|
| 6,397,948 | B1 | 6/2002 | Williams et al. | |
| 6,591,774 | B2 | 7/2003 | Robinson | |
| 6,591,775 | B2 | 7/2003 | Robinson | |
| 2004/0262010 | A1 | 12/2004 | Milberger | |
| 2005/0121198 | A1 | 6/2005 | Andrews | |
| 2013/0126179 | A1* | 5/2013 | Cumming | F17D 3/14 166/336 |
| 2013/0336721 | A1 | 12/2013 | McBride et al. | |
| 2015/0021040 | A1* | 1/2015 | Johal | E21B 33/035 166/368 |
| 2016/0130918 | A1* | 5/2016 | Bhatnagar | E21B 37/00 166/368 |

FOREIGN PATENT DOCUMENTS

| | | | |
|---|---|---|---|
| CN | 103382825 | A | 11/2013 |
| GB | 2191841 | A | 12/1987 |
| GB | 2410970 | A | 8/2005 |
| GB | 2440940 | A | 2/2008 |
| GB | 2495836 | A | 4/2013 |
| RU | 2420655 | C1 | 6/2011 |
| WO | 2007011237 | A2 | 1/2007 |

OTHER PUBLICATIONS

Norsok Standard, Process systems, P-100, Rev. 2, Nov. 2001 (131 pp.).

Norsok Standard, Process Design, P-001, Rev. 3, Nov. 1997 (29 pp.).

Aarnes, K.S., et al., Thermal Design of a Dalia SPS Deepwater Christmas Tree—Verified by Use of Full-Scale Testing and Numerical Simulations, Offshore Technology Conference, 2005 (11 pp.).

Office Action, NO20170230, dated Dec. 16, 2019 (5 pp.).

Cagney, T., et al., "Hydrate inhibition of subsea jumpers during shut-in", SPE Annual technical conference and exhibition, San Antonio, Texas, 24027 Sep. 2006 (11 pp.).

Office Action, RU 201790412/31, dated Dec. 23, 2019 (2 pp.) (in Russian).

Office Action, RU 201790412/31, dated Dec. 23, 2019 (2 pp.) (in English).

* cited by examiner

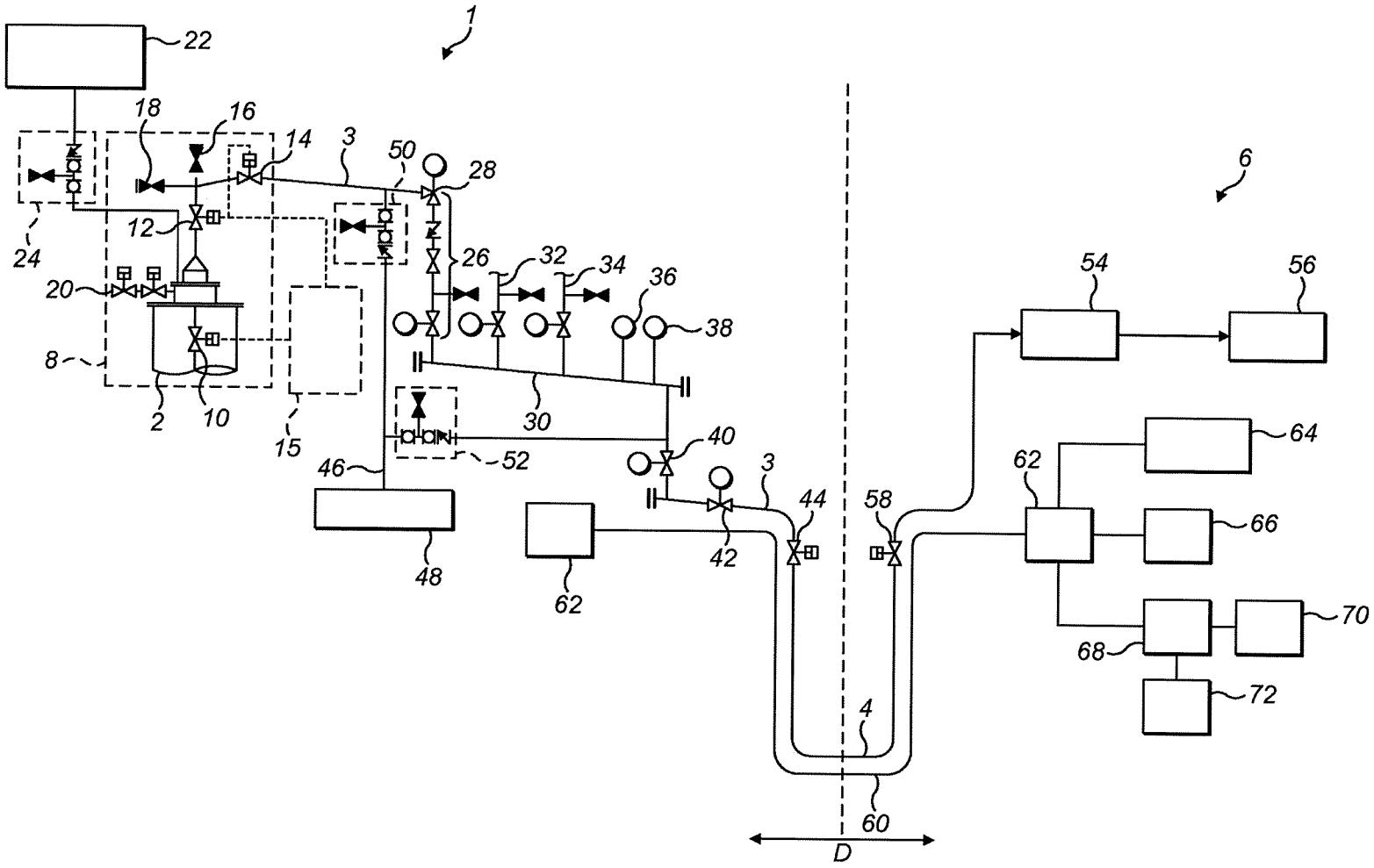
1
2
3
4
6
8
10
12
14
15
16
18
20
22
24
26
28
30
32
34
36
38
40
42
44
46
48
50
52
54
56
58
60
62
64
66
68
70
72
D

WELLHEAD ASSEMBLY

RELATED APPLICATIONS

The present application is a Divisional of application Ser. No. 15/502,943, filed on Feb. 9, 2017, now allowed, which, in turn, is a 371 application of International Application No. PCT/NO2015/050135, filed on Aug. 17, 2015, which, in turn, claims priority from UK Application No. 1414733.4, filed on Aug. 19, 2014. Each of these applications is incorporated herein by reference in full.

TECHNICAL FIELD

The invention relates to a wellhead assembly and more specifically the drainage of a wellhead assembly and/or the depressurising of a wellhead assembly.

BACKGROUND OF THE INVENTION

Occasionally it is necessary to shut down a wellhead platform, for example during an emergency or for planned maintenance. When the platform is shut down it is necessary to drain the fluid which has been extracted from a well from the process equipment on the wellhead platform.

The fluid in the process equipment is usually drained using a drainage system on the wellhead platform. A typical drainage system comprises a drainage tank which is connected via drainpipes to all of the low points of the process equipment where the liquid collects. When the system is shutdown the drainage system including the drainpipes can be opened by manually opening valves so that the fluid in the process equipment after the well has been shut can be drained or pumped from the process equipment into the drainage tank.

The process equipment is routed around the platform so that there can be personnel access to all process equipment. This means that the personnel can operate the drainage system during shutdowns to remove the extracted fluid from the process equipment.

There is an increasing desire to minimise the amount of equipment on a wellhead platform and to reduce the amount of manual intervention which is required. This is particularly in the case of offshore unmanned wellhead platforms. This is because there will not be personnel stationed on the platform itself and so it is desirable to reduce the amount of time required to perform maintenance.

SUMMARY OF THE INVENTION

According to a first aspect, the present invention provides a wellhead assembly, the wellhead assembly comprising: a production well; a first valve; process equipment; a transport pipe for transporting fluid away from the wellhead assembly; and piping fluidly connecting the production well to the first valve, the process equipment, and the transport pipe, wherein the first valve is located between the production well and the process equipment, and wherein there is a fall in the piping between the first valve and the transport pipe such that, when the first valve is closed, liquid will drain from the first valve into the transport pipe under the action of gravity.

With this arrangement, because liquid will drain from the first valve into the transport pipe when the first valve is shut, it is not necessary to provide a separate drainage system with a drainage tank as discussed above. Thus the wellhead assembly may be arranged so that it does not have a separate drainage system and/or a drainage tank.

It also means that it is not necessary to provide a means for empting the drainage tank after the system has been shut down. This results in it being possible to reduce the number of components on the wellhead assembly. This in turn can reduce the amount of operational and maintenance time which is required and can also reduce the capital and operational expenditure costs of the wellhead assembly.

It is common in known wellhead assemblies for the space around a wellhead to be fairly limited. This is because it is common for there to be multiple production wells in a relatively small area. As a result, the piping usually follows a tortuous path which includes vertical sections in which fluid flows from the bottom to the top of the pipe against gravity. During normal operation this is acceptable as the pressure of the fluid being extracted drives the liquid through the piping to the transport pipe from where it can be transported to its intended destination.

Additionally, it is common for the flow of fluid from a wellhead to be measured with sensors, such as flow meters, which are calibrated to take measurements on vertical sections of piping. Therefore, it has previously been desirable to have vertical sections of piping in the process equipment of a wellhead assembly.

With this vertical arrangement, the piping forms pockets where liquid collects after the flow of fluid from the wellhead is stopped. As discussed above, fluid is drained from these pockets by drainpipes into a drainage tank which is connected to each of these pockets.

In the present invention, the piping may provide a fluid path from the production well to the transport pipe so that fluid extracted from the well (which may comprise gas, oil and/or water) can be directed to the transport pipe from where it can be fed to another location to be processed. Thus extracted fluid flows from the production well through the piping in turn through the first valve, though the process equipment, and then into the transport pipe. This piping is arranged so that it can drain in the case of a shutdown under the action of gravity.

When the term pipe or piping it is used in the present specification it is meant a conduit or conduits though which a fluid may be transported. The piping does not have any particular shape or cross section and is intended to cover any shaped conduit or passage for directing the flow of a fluid.

The requirement for the liquid to drain from the first valve to the transport pipe means that substantially or essentially all of the liquid which is in the piping between the first valve and the transport pipe immediately after the first valve is shut will, after a certain amount of time, be transported under the action of gravity into the transport pipe. This is only substantially or essentially all of the liquid rather than an absolute all of the liquid because it will be appreciated that some liquid will remain in the pipe due to factors such as surface wetting of the internal surface of the piping. However, it is desirable for no (substantial) pockets of liquid to remain in the system after the wellhead assembly has been shut down.

It is desirable for the liquid to drain to a sufficient extent so that the assembly can be made safe in the case of an emergency or so there is sufficiently little liquid remaining in the piping so that maintenance can be performed safely.

The wellhead assembly may comprise a second valve.

The second valve may be located between the process equipment and the transport pipe (with respect to the fluid flow path). The piping may fluidly connect the process equipment to the second valve and the transport pipe. As a result the extracted fluid may flow from the process equipment, through the second valve into the transport pipe.

The second valve may be at the start of the transport pipe. The fall in the piping may be from the first valve to the second valve and/or the start of the transport pipe.

There may be a fall in the piping between the first valve and the second valve such that when the first valve is closed, liquid will drain from the first valve through the second valve into the transport pipe under the action of gravity alone.

Owing to the fact that it will take time for liquid to drain from the first valve past the second valve into the transport pipe, the assembly may be arranged so that the first valve is shut and the second valve is shut a certain amount of time after the first valve is shut.

This certain amount of time may be between 5 and 20 minutes or 10 to 15 minutes.

The length of time between the first valve being shut before the second valve is shut, i.e. the length of time for liquid to drain from the first valve to or past the second valve, will depend on a number of factors. These factors may include the magnitude of the fall (i.e. the gradient) of the piping between the first valve and the second valve and/or transport pipe (i.e. how sloped the piping and process equipment is), the viscosity of the fluid/liquid being extracted, the length of piping between the first valve and the transport pipe etc.

The length of time required to drain substantially all the liquid from the first valve to the second valve and/or the transport pipe after the first valve is shut may be calculated based on a simulation of the system. Alternatively it may be calculated based on tests performed on the installed assembly before the system is fully operational.

The length of the piping between the first valve and the transport pipe or second valve may be about 10 to 30 m, for example about 20 m.

When the assembly comprises further valves between the first valve and the second valve, the system may be arranged to close the valves sequentially from the first valve along the piping to the second valve, i.e. there may be a sequenced shut down of the valves from the first valve to the second valve. The valves may be arranged so that the sequenced shut down occurs at a rate so that substantially all of the liquid has drained from the piping between the first valve and the valve being shut before the valve is closed.

The wellhead assembly may be onshore or offshore. If the wellhead assembly is offshore it may be subsea or topside. The wellhead assembly may for example be a wellhead platform such as an unmanned wellhead platform. The wellhead platform may be a fixed foundation offshore platform or a floating offshore platform.

The present invention is particularly advantageous in the case of an offshore unmanned wellhead platform (either fixed foundation or floating) because in this case there is a particular need to minimise equipment on the wellhead platform so as to help minimise the amount of maintenance required.

By there being a fall in the piping it is meant that over a horizontal distance the pipe drops by a vertical distance, i.e. the pipe may be sloped in relation to the horizontal. The fall in a pipe may be defined as the vertical amount by which the pipe drops over a horizontal distance. In the present invention the fall of the piping may be such that liquid from the valve may flow the entire distance from the first valve through the second valve (if present) and into the transport pipe. In other words, when the first valve is shut, liquid which is at the valve at the point it is shut may flow under the action of gravity alone to the transport pipe.

The fall of the piping may be about 1:100, i.e. for each 100 m of piping in a horizontal direction, the vertical distance the pipe drops is 1 m. The fall between the first valve and the transport pipe may be between 1:40 to 1:200.

When the wellhead assembly is onshore, i.e. land based, the fall may be as low as 1:200 as the structure will be fixed and relatively static. However, when the assembly is offshore the fall in the piping maybe between 1:40 and 1:110.

These figures may be the overall or the average fall, i.e. the total horizontal distance of the piping compared to the total vertical drop. These values provide adequate flow of liquid in the piping so as to cause liquid to drain from the pipes in the wellhead assembly under the action of gravity. The fall of the piping along its entire length may be between 1:40 to 1:200 (or 1:40 to 1:110, if for example, the assembly is located offshore) or vertical. In other words, the fall in the piping may never be greater than 1:40 (unless it is vertical) or less than 1:200 (or 1:110) from the first valve to the transport pipe and/or second valve.

In the cases where the piping has portions which are vertical, the fluid flowing from the first valve to the transport pipe will flow from the top to the bottom of the vertical portions under the action of gravity.

The piping may be only downwardly sloped or vertical, i.e. there may be no horizontal portions of piping. There are preferably no portions of the piping in which liquid can collect after the valves are shut. For example there are preferably no U-bends or upward sloping or vertical portions which can create pockets in the piping which can trap liquid and thus prevent liquid draining from the first valve to the transport pipe under the action of gravity.

In the case of a wellhead assembly which is on a floating platform the fall (average and/or continuous fall) in the piping from the first valve to the transport pipe and/or second valve may be between 1:40 to 1:60, e.g. about 1:50, or vertical. This is because in the case of a floating platform it is desirable for the flow path to have a steeper gradient to account for the wellhead assembly moving due to the fact that it is floating.

The fall may also be referred to as the slope of the pipe.

The fall of the piping may vary, i.e. there may be steeper parts and shallower parts, providing the overall or average fall is sufficient to cause liquid to drain from the first valve to the transport pipe under the action of gravity.

The piping may be sloped along its entire length from the first valve to the transport pipe. Alternatively, the piping may also comprise some horizontal portions, providing the overall or average fall is sufficient for substantially all of the liquid to be drained from the piping into the transport pipe under the action of gravity alone after the first valve is shut.

The piping between the production well and the first valve may have a fall such that when the first valve is closed liquid will drain from the first valve back to the production well under the action of gravity.

This means that the system is arranged so that when the first valve is closed the liquid which is at the first valve at the time when it is shut will either drain to and into the transport pipe or back into the production well (depending on which side of the first valve it is after the first valve is shut) and thus the piping of the assembly can be substantially free of liquid a given amount of time after the first valve is shut.

The first valve may be a wing valve, such as a production wing valve, and may be used to control the flow of fluid or stop production from the production well. The first valve may be part of a standard Christmas tree which is on the production well.

With respect to the fluid path from the production well to the transport pipe the first valve may be at the highest point in the fluid path. The fluid which is extracted from the production well may flow up (i.e. in a direction away from the ground or seabed) and along to the first valve and may then flow down (i.e. in a direction towards the ground or seabed) and along to the second valve (if present) and transport pipe.

The assembly may comprise a plurality of production wells and a plurality of first valves. Fluid extracted from the plurality of wells may be directed through each of their respective first valves and then combined before flowing through a single second valve (if present) and into the single transport pipe.

The process equipment may comprise a manifold, e.g. a production manifold. The manifold may be arranged to receive and combine the fluid extracted from a plurality of production wells before it is directed via piping into the transport pipe. With this arrangement, the manifold may also have a fall so that liquid can drain from the manifold under the action of gravity alone.

The fluid path through the process equipment through which the extracted fluid flows may also have a fall, i.e. be sloped, so that liquid will drain from the process equipment to the transport pipe under the action of gravity.

The process equipment may comprise one or more valves for controlling the flow of fluid through the piping. For example, the process equipment may comprise a choke valve.

When the assembly comprises a choke valve, the choke valve may be near the first valve, for example within 1 m of the first valve, within 0.5 m or within 0.1 m of the first valve (i.e. fluid flowing from the first valve to the choke valve may only flow through less than 1 m, less than 0.5 m or less than 0.1 m of piping).

The process equipment may comprise one or more sensors which can be used to monitor the fluid following through the process equipment. For example the assembly may comprise a pressure transducer and/or a temperature transducer.

The assembly may comprise valves between the production well and the first valve. For example, these valves may comprise a downhole safety valve and a master safety valve. These valves may be part of a Christmas tree which is on the production well.

The wellhead assembly may comprise a well controller which can control the first valve. If other valves are present in the assembly, the controller may also control one or more of these other valves.

The assembly may comprise an intervention valve for allowing intervention equipment to be put into the production well. The assembly may comprise an acid valve which permits chemicals such as acids to be put into the well to allow the downhole chemistry to be controlled. The assembly may also comprise a wax/scale inhibitor valve to permit the input of wax and/or scale inhibitors into the well.

If present, the intervention valve, acid valve and/or the wax/scale inhibitor valve may be part of a Christmas tree on the production well.

When the assembly comprises a second valve, the second valve may be an emergency shutdown valve. The second valve may be the last valve in the assembly (with respect to the fluid flow path) before the transport pipe.

The transport pipe may be a subsea or subsurface pipeline which directs the extracted fluid away from the wellhead assembly on for further processing, for example, it may carry the fluid back to a host platform.

The assembly may comprise a service line. The service line may be used to supply chemicals, such as inhibitors, to the assembly. For example, the service line may be used to supply hydrate inhibitors, such as methanol and/or monoethylene glycol (MEG), to the assembly so as to help prevent the formation of hydrates in the assembly.

The service line may be arranged so that the chemicals can be provided to multiple locations in the assembly, i.e. there may be multiple lines connected to various positions in the piping or process equipment of the wellhead assembly.

For example, the service line may be arranged to provide chemicals directly to the piping near the first valve and also to provide the chemicals directly to the piping near the second valve and/or after the process equipment. In other words, the service line may be arranged to be able to provide chemicals, such as hydrate inhibitors, to a location relatively near the production well and to a location relatively near the transport pipe, i.e. near the beginning of the piping and near the end of the piping.

The service line may comprise one or more valves to control the flow of chemicals into the piping and/or to prevent extracted fluid from entering the service line rather than flowing to the transport pipe during normal production.

When a wellhead assembly is shut down in an emergency, or as part of a planned shut down during maintenance, it is also desirable to depressurise the system by removing gas from the piping and process equipment which has been extracted from the production well.

In prior art systems this is commonly achieved using a flare system which can provide a route for gas to escape the piping and/or process equipment. The flare system may have been incorporated with the drainage system.

Given that the drainage system has been eliminated and it is desired to minimise the amount of equipment in a wellhead assembly, there is a desire to provide a way of depressurising the assembly after a shut down without a separate flare system.

It has been realised that it is possible for the service line to also be used as a means to depressurise the assembly. It has been realised that this can be used in combination with the invention of the first aspect when a service line is provided in the wellhead assembly, however, this feature is also of independent patentable significance.

Thus in a second aspect the present invention provides a wellhead assembly, the wellhead assembly comprising: a production well; process equipment; a transport pipe for transporting fluid away from the wellhead assembly; piping; and a service line, wherein the piping fluidly connects the production well to the process equipment and the transport pipe, and wherein the service line is arranged so that it can be used to provide chemicals to the piping and process equipment and arranged so that it can be used to depressurise the piping and process equipment after a shutdown.

By depressurise it may be meant that the gas in the piping is vented so that the remaining gas in the assembly is at, or near, atmospheric pressure.

The chemicals which can be provided by the service line may be hydrate inhibitors such as methanol and/or MEG.

The invention of the second aspect, i.e. that the service line may during normal operation be used to provide chemicals to the piping and process equipment of a wellhead assembly and during a shutdown it may be used as a means to depressurise the system, may be in combination with one or more of the features of the invention of the first aspect.

Normal operation is during production when extracted fluid flows from the production well to the transport pipe. Shut down is when one or more valves, such as the first valve, is closed to prevent fluid flowing from the production well to the transport pipe.

After the assembly has been depressurised the assembly may be purged or flushed with a gas, e.g. an inert gas such as nitrogen.

This purge is performed to remove or reduce the hydrocarbons remaining in the assembly before maintenance is performed. This is especially desirable when the maintenance includes removing components, such as parts of the process equipment.

The purge gas may be provided from a line in the umbilical or from containers on the platform.

The gas which is purged or flushed from the assembly may be vented to any appropriate safe location on the platform. For example, the gas may be vented from a location near the first valve and/or the second valve.

Any of the features or optional features discussed above in relation to the first aspect may be present in the invention according to the second aspect and any of the features or optional features of the second aspect of the invention may be applicable to the invention of the first aspect.

The service line may be connected to the piping at a section which is substantially free of liquid after the assembly is shut down. By shut down it may be meant that fluid is prevented from flowing from the production well to the transport pipe.

The service line may be connected to or near the uppermost section (with respect to the fluid path of the fluid extracted from the production well to the transport pipe) of the piping.

This is because only gas should be permitted to flow from the piping of the wellhead assembly into the service line. This is to avoid water entering the service line which can result in the formation of hydrates which could restrict of block the service line.

The service line may be connected to an umbilical. The umbilical can provide the chemicals, such as hydrate inhibitors, which are provided into the wellhead assembly during normal operation. These chemicals may come, for example, from a host platform and be transported to the assembly via the umbilical and the service line. During a shut down when the service line acts as a vent to depressurise the assembly, the umbilical may be used to transport the gas away from the assembly, for example, back to a host platform.

When the assembly comprises the first valve, the service line may be connected to the piping near the first valve, for example within 1 m of the first valve, within 0.5 m or within 0.1 m of the first valve.

The connection between the service line and the piping may be located between the first valve and another valve (which may, for example, be a choke valve).

As discussed above, the service line may be arranged so that chemicals can be provided to a plurality of locations in the assembly. However, when the service line is connected to the assembly at a plurality of locations, the service line may be arranged to only depressurise from the location which is highest (with respect to the fluid flow path) in the assembly. This means that the risk of liquid entering the service line can be minimised.

The piping to which the service line is connected may be sloped so that after a shut down the point at which the service line is connected to the piping is substantially free of liquid.

In a third aspect the present invention provides a method of draining a wellhead assembly, the method comprising: extracting a fluid from a production well and directing it though piping in the wellhead assembly from a first valve to a transport pipe; shutting down the wellhead assembly by closing the first valve; draining liquid from the first valve to the transport pipe under the action of gravity.

The present invention may provide a method of draining the wellhead assembly of the first aspect.

The invention according to the third aspect may comprise one or more of the features (including one or more of the optional features) of the first or second aspects of the invention.

The liquid may be drained from the first valve to the transport pipe under the action of gravity alone. This may be achieved, as discussed in more detail above, by having a fall in the piping from the first valve to the transport pipe.

The steps of the method may be performed in sequence, i.e. it starts with fluid being extracted from the production well, i.e. normal operation, then the assembly being shut down, and then the liquid being drained from the piping into the transport pipe.

The wellhead assembly may comprise a plurality of valves along the piping from the first valve to the transport pipe. In this case, the method may comprise sequentially closing the valves along the fluid path, i.e. there may be a sequenced shut down of the valves from the first valve to the second valve. The sequenced shut down may occur at a rate so that substantially all of the liquid has drained from the piping between the first valve and the valve being shut before the particular valve is closed.

The length of time required to drain substantially all the liquid from the first valve to the transport pipe after the first valve is shut may be calculated based on a simulation of the system. Alternatively it may be calculated based on tests performed once the assembly has been installed but before the system is fully operational.

The method may comprise depressurising the assembly after liquid has been drained from the first valve to the transport pipe.

The depressurising of the wellhead assembly may be performed using a service line of the wellhead assembly. Thus the method may comprise, after the liquid has been drained from the assembly, opening the service line so as to depressurise the system.

The service line may have one or more of the optional features discussed above.

In a fourth aspect, the present invention provides a method of depressurising a wellhead assembly, the method comprising: extracting a fluid from a production well and directing it though piping in the wellhead assembly from a first valve to a transport pipe; shutting down the wellhead assembly by closing the first valve; and depressurising the assembly using a service line which is in communication with the piping.

The method may comprise draining liquid from the assembly prior to performing the depressurising step.

As with all the other aspects, the invention of the fourth aspect may comprise one or more of the features, including the optional features, of one or more of the other aspects.

BRIEF DESCRIPTION OF THE DRAWINGS

Certain preferred embodiments of the present invention will now be described by way of example only with reference to the accompanying drawing, in which:

FIG. 1 shows a schematic of a wellhead assembly linked via a transport pipe to a host platform.

DETAILED DESCRIPTION

In FIG. 1 the wellhead assembly 1 may be an offshore unmanned wellhead platform and may be referred to herein as simply an assembly. The platform 1 may either be a fixed foundation platform or a floating platform.

The wellhead assembly 1 comprises a production well 2 from which a fluid which comprises oil, water and gas is extracted.

The extracted fluid is directed via piping 3 and process equipment to a transport pipe 4 which leads to a host platform 6 which will be discussed in more detail below.

Located on the production well 2 is a standard Christmas tree 8. The Christmas tree 8 comprises a number of valves to control the flow of fluid (i.e. stop the flow or control the amount of fluid flowing) from the production well 2 and control the inflow of chemicals into the production well and permit intervention equipment to be inserted into the well.

Specifically, the Christmas tree 8 comprises a downhole safety valve 10, a master safety valve 12 and a wing valve 14. These valves can be used together to control the flow of fluid from the production well 2 and to cause a shutdown of the well 2 during an emergency or planned maintenance procedure.

The Christmas tree 8 also comprises an intervention valve 16 which permits intervention equipment to be inserted into the well 2 as required (for example during maintenance procedures).

A number of the valves of the Christmas tree 8 (such as the downhole safety valve 10, the master safety valve 12 and the wing valve 14) may be controlled by a well control panel 15. The well control panel 15 may also control other parts of the wellhead assembly 1. The well control panel 15 may be able to be operated remotely. This means that the flow of fluid from the well 2 can be controlled even if there are no personnel stationed on the platform 1 itself.

The Christmas tree 8 may comprise a side valve 18 which permits chemicals such as acids to be pumped into the well. This means that the downhole chemistry can be controlled.

The Christmas tree 8 may comprise additional valves 20 which can either be to further control the flow of fluid from the production well or to permit further chemicals to be pumped into the well 2.

The wellhead assembly 1 may comprise a source of wax and/or scale inhibitors 22. These may be pumped directly into the well 2 as shown schematically in FIG. 1. The flow of these wax and/or scale inhibitors may be controlled by valves 24.

Along the flow path from the Christmas tree 8 the assembly comprises a series of valves 26. These valves 26, which include a choke valve 28, can be used to control the flow of fluid from the Christmas tree 8 to a production manifold 30.

The production manifold 30 is arranged to receive the fluid from a number of production wells 2. In the schematic arrangement shown in FIG. 1, the assembly comprises three sources of extracted fluid being combined in the production manifold 30. For clarity, the well 2 and Christmas tree 8 and associated components are not shown for the second 32 and third 34 sources of extracted fluid.

A number of production wells 2 may be located in relatively close proximity to each other in an oil field. Therefore, it is cost effective to combine these sources of extracted fluid in a production manifold 30 before being transported back to a main host platform 6 via a single transport pipe 4.

The fluid in the production manifold 30 may be monitored by a number of sensors such as a pressure transducer 36 and/or a temperature transducer 38.

The combined fluid may be further controlled by a number of valves 40, 42 before passing through an emergency shutdown valve (ESD) 44 into the transport pipe 4.

As illustrated schematically in FIG. 1, a number of the valves may be associated with motors which permit the valves to be opened and closed. It may be possible to operate these remotely so that personnel do not need to be stationed at the platform during operation or shutdown of the assembly.

The transport pipe 4 may be a subsea pipeline which extends over a distance (D) of up to 20 km (e.g. 15 km) at the sea bed to a host platform 6. The transport pipe may for example extend down by up to 150 m or more to the sea bed from the ESD valve 44 depending on the distance of the platform from the seabed.

The wellhead assembly 1 may also comprise a service line 46 which is connected to a source of chemicals 48. The chemicals may for example be hydrate inhibitors such as methanol and/or monoethylene glycol (MEG) which are supplied to the piping 3.

As shown in FIG. 1, the service line is connected to the piping 3 at two locations. However, the service line may be connected at only one location or at multiple locations.

In the present embodiment, the service line is connected to the piping 3 in between the wing valve 14 and the choke valve 28 and after the production manifold 30.

The inflow of chemicals from the service line 46 to the piping 3 is controlled by valves 50 and 52.

The service line 46 is arranged so that during a shutdown, once the piping 3 has been drained of liquid, the service line 46 can be used to depressurise the system by providing an outlet for gas.

This may be achieved by, once the system has been drained of liquid, the valve 50 on the service line 46 is opened so that the uppermost point at which the service line 46 connects with the piping 3 (i.e. a location near the wing valve 14) can act as an outlet vent for the pressurised gas in the wellhead assembly 1.

When the extracted fluid reaches the host platform 6 it is received in a metering unit 54 before being directed to a reception facility 56. From the reception facility 56 the fluid can be directed onto processing facilities as desired. The flow of fluid from the transport pipe 4 to the host platform 6 may be controlled by a valve 58.

An umbilical 60 also runs between the wellhead assembly 1 and the host platform 6. The umbilical 60 is used to supply power, control signals and chemicals to the wellhead assembly 1 to aid the operation of the wellhead assembly.

The umbilical 60 is terminated on each of the wellhead assembly 1 and the host platform 6 by a topside umbilical termination unit (TUTU) 62. The TUTU 62 on the host platform 6 is connected to a number of modules which may include a source of chemicals 64 which may include wax inhibitor, scale inhibitor and/or hydrate inhibitor. The modules may also comprise a hydraulic power unit (HPU) 66 and a master control unit (MCU) 68 which is connected to an integrated control and safety system (ICSS) 70 and an electrical power unit (EPU) 72.

During normal production operation, fluid is extracted via the production well 2 and flows through the Christmas tree 8 including the wing valve 14, to piping 3. The piping 3 directs the extracted fluid through the process equipment which includes a number of valves and the production manifold 30 and the ESD valve 44 to the transport pipe 4 from where it can be directed to the host platform 6.

Occasionally, for example in emergencies or during planned maintenance of the assembly 1, it is necessary to shutdown the wellhead assembly 1. This is achieved by shutting one or more of the valves, such as the wing valve 14 to prevent fluid flowing from the production well 2 to the transport pipe 4.

During a shutdown of the assembly 1 it is necessary to drain the piping 3 and process equipment to make the assembly safe.

To minimise the number of components, the wellhead assembly 1 does not comprise a drainage system. In the present case the drainage of the piping 3 and process equipment is achieved by all of the piping having a fall such that, when the wing valve 14 is shut, the fluid which is at the wing valve 14 at the point at which it is shut will flow into the transport pipe 4. In other words, the piping and process equipment is sloped and/or vertical so as to provide no 'pockets' where liquid can be trapped.

The average fall from the wing valve to the transport pipe may be between 1:40 to 1:110, i.e. for each 40 to 110 m in a horizontal direction along the piping, the piping drops by 1 m. The fall may vary along the length providing it averages to between 1:40 to 1:110 and is such that substantially all of the liquid will drain from the assembly under the action of gravity alone.

FIG. 1 is purely schematic and generally shows the pipes as either sloped or vertical. The piping 3 and fluid path within the process equipment, including the production manifold 30, may all be sloped as discussed herein and may have a greater or less slope than that shown in the FIGURE.

The piping may slope away from the wing valve 14 on either side of the wing valve 14 such that, with respect to the fluid flow path, the wing valve is at the uppermost point. This means that liquid at the wing valve 14 when the wing valve is shut will either flow back into the production well 2 or through the piping 3 and process equipment to the transport pipe 4 under the action of gravity alone.

This means that substantially all of the liquid present in the piping 3 between the wing valve 14 and the transport pipe 4 can drain out of the piping and process equipment under the action of gravity alone.

The piping from the production well 2 to the wing valve 14 may also have a fall such that when the wing valve is shut substantially all of the liquid in the piping on the production side of the wing valve 14 will drain back into the production well 1 under the action of gravity alone.

During a shutdown, first the wing valve 14 may be shut. Then there may be a waiting time whilst the liquid in the piping is draining under the action of gravity into either the transport pipe 4 or the production well 2. Once this waiting time has lapsed since the wing valve 14 was shut, the final valve before the transport pipe 4, i.e. the ESD valve 44, may be shut.

The valves along the flow path from the wing valve 14 to the transport pipe 4 may be shut sequentially. The timing between each valve being shut along the flow path is such that the liquid has substantially all drained from the flow piping 3 or process equipment before the valve, before the valve is shut. The timing will depend on a number of factors such as the length of the flow path, the gradient of the piping or process equipment and the viscosity of the extracted fluid etc. The timing may be calculated based on a simulation of the assembly 1 or on experiments conducted on the installed assembly 1 before the well is operational.

After the liquid has been drained under the action of gravity into the transport pipe 4 the assembly 1 may be depressurised by opening the valve 50 on the service line 46. This creates a vent in the uppermost section of the piping near the wing valve 14.

The pressurised gas in the piping 3 can therefore be vented via the service line 46 from where it can be routed back to the host platform 6 via the umbilical 60.

The assembly 1 may then be purged or flushed using nitrogen gas. This is to remove or reduce the hydrocarbons remaining in the assembly before maintenance is performed.

The nitrogen gas may be supplied through the umbilical 60 from the host platform 6. The gas which is purged or flushed from the assembly 1 may be vented to any appropriate safe location on the platform 1. For example, the gas may be vented from a location near the wing valve 14 and/or the ESD valve 44.

As mentioned previously, the arrangement shown in FIG. 1 is purely schematic. As a result it illustrates the components which are in the assembly but is not necessarily representative of their relative sizes. Also, the FIGURE is not illustrative of the relative distances between components. For example, the connection point between the service line 46 and the piping 3 may be very close to the wing valve 14. The connection point is shown to be some distance from the wing valve 14 for clarity. In practice the distance between the wing valve 14 and the choke vale 28 may be less than 60 cm for example about 30 cm. Also, as mentioned above, the piping 3 and process equipment in practice it is sloped or vertical to ensure that liquid can drain therefrom under the action of gravity alone.

It should be apparent that the foregoing relates only to the preferred embodiments of the present application and the resultant patent. Numerous changes and modification may be made herein by one of ordinary skill in the art without departing from the general spirit and scope of the invention as defined by the following claims and the equivalents thereof.

I claim:

1. A method of draining a wellhead assembly, the method comprising:

extracting a fluid from a production well and directing it though piping in the wellhead assembly from a first valve, through process equipment to a transport pipe such that fluid flows from the production well through the piping, through in turn through the first valve, through the process equipment and then the transport pipe;

shutting down the wellhead assembly by closing the first valve; and draining liquid from the first valve and the process equipment to the transport pipe under the action of gravity.

2. A method according to claim 1, wherein the wellhead assembly comprises a plurality of valves along the piping from the first valve to the transport pipe and wherein the step of shutting down the wellhead assembly comprises sequentially closing the valves along the fluid path.

3. A method according to claim 2, wherein the sequenced shut down of the valves occurs at a rate so that substantially all of the liquid has drained from the piping between the first valve and the valve being shut before the particular valve is shut.

4. A method according to claim 1, wherein the method comprises depressurising the assembly after liquid has been drained from the first valve to the transport pipe.

5. A method according to claim 4, wherein the wellhead assembly comprises a service line and wherein the method comprises, after the liquid has been drained from the assembly, opening the service line so as to depressurise the piping of the assembly.

6. A method according to claim 1, wherein the process equipment is between the first valve and the transport pipe such that fluid is directed from the production well through the piping, in turn through the first valve, through the process equipment, and then the transport pipe, wherein the process equipment comprises a manifold which is arranged to receive fluid from a plurality of production wells, wherein the first valve is located between the production well and the process equipment, and wherein there is a fall in the piping between the first valve and the transport pipe such that when the first valve is closed liquid will drain from the first valve and the process equipment into the transport pipe under the action of gravity.

7. A method of draining a wellhead assembly, the method comprising:

extracting a fluid from a production well and directing it through piping in the wellhead assembly from a first valve, through process equipment to a transport pipe;

shutting down the wellhead assembly by closing the first valve;

draining liquid from the first valve and the process equipment to the transport pipe under the action of gravity; and depressurising the assembly after liquid has been drained from the first valve to the transport pipe.

* * * * *